US008755711B2

(12) United States Patent
Sasai et al.

(10) Patent No.: US 8,755,711 B2
(45) Date of Patent: Jun. 17, 2014

(54) IMAGE FORMING APPARATUS AND IMAGE FORMING METHOD

(75) Inventors: Takahiro Sasai, Kyoto (JP); Yuji Suzuki, Kyoto (JP); Yoshitaka Taruno, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 291 days.

(21) Appl. No.: 13/392,591

(22) PCT Filed: Aug. 13, 2010

(86) PCT No.: PCT/JP2010/063769
§ 371 (c)(1),
(2), (4) Date: Mar. 2, 2012

(87) PCT Pub. No.: WO2011/024658
PCT Pub. Date: Mar. 3, 2011

(65) Prior Publication Data

US 2012/0163835 A1 Jun. 28, 2012

(30) Foreign Application Priority Data

Aug. 31, 2009 (JP) ..... 2009-200754

(51) Int. Cl.
*G03G 15/00* (2006.01)
*G03G 15/02* (2006.01)

(52) U.S. Cl.
CPC ..... *G03G 15/0291* (2013.01); *G03G 15/0225* (2013.01)
USPC ..... 399/100; 399/50

(58) Field of Classification Search
CPC ..... G03G 15/0225; G03G 15/0291
USPC ..... 399/50, 100
See application file for complete search history.

(56) References Cited

U.S. PATENT DOCUMENTS 5,392,099 A * 2/1995 Kusumoto et al. ..... 399/100
2008/0175608 A1 7/2008 Kobashigawa

FOREIGN PATENT DOCUMENTS

| | | | | |
|---|---|---|---|---|
| JP | 4-296879 A | | 10/1992 | |
| JP | 9-258528 A | | 10/1997 | |
| JP | 11-024375 A | | 1/1999 | |
| JP | 11024375 A | * | 1/1999 | ..... G03G 15/02 |
| JP | 11-327352 A | | 11/1999 | |
| JP | 2002-132018 A | | 5/2002 | |
| JP | 2006-184826 A | | 7/2006 | |
| JP | 2006-251195 A | | 9/2006 | |

(Continued)

OTHER PUBLICATIONS

Official Communication issued in corresponding Japanese Patent Application No. 2009-200754, mailed on Sep. 11, 2012.

(Continued)

*Primary Examiner* — David Gray
*Assistant Examiner* — Michael Harrison
(74) *Attorney, Agent, or Firm* — Keating & Bennett, LLP

(57) ABSTRACT

When printing, an image forming apparatus determines, based on a threshold voltage corresponding to a print speed during printing, whether or not a corona wire of a charger needs to be cleaned. On the basis of whether or not a monitoring voltage corresponding to a current value of a charged bias, which is applied to the corona wire by a charged-bias high-voltage power supply, is equal to or more than a predetermined threshold voltage corresponding to the print speed during printing, the image forming apparatus determines whether or not the corona wire needs to be cleaned.

16 Claims, 4 Drawing Sheets

(56) References Cited

FOREIGN PATENT DOCUMENTS

| | | | | |
|---|---|---|---|---|
| JP | 2006-330648 | A | | 12/2006 |
| JP | 2006330648 | A | * | 12/2006 |
| JP | 2008-181101 | A | | 8/2008 |
| JP | 2009-63936 | A | | 3/2009 |

OTHER PUBLICATIONS

English translation of Official Communication issued in corresponding International Application PCT/JP2010/063769, mailed on Mar. 22, 2012.

Official Communication issued in International Patent Application Na PCT/JP2010/063769, mailed on Sep. 14, 2010.

* cited by examiner

IMAGE FORMING APPARATUS AND IMAGE FORMING METHOD

BACKGROUND OF THE INVENTION

1. Field of the Invention

The present invention relates to an image forming apparatus and an image forming method using a discharger in which a corona discharging system is used, and forming an image based on image data on a paper by an electrophotographic system.

2. Description of the Related Art

An image forming apparatus using an electrophotographic process exposes a photosensitive member (image bearing body) charged by a charger based on image data to be processed, to form an electrostatic latent image on the photosensitive member. Moreover, the image forming apparatus supplies charged toner (developer) to the latent image by a developing unit, to form a toner image on the photosensitive member. The image forming apparatus transfers the toner image formed on the photosensitive member onto a paper by a transfer unit. The image forming apparatus then fuses the transferred toner image to the paper by a fuser, to form an image on the paper. Such an image forming apparatus may use, as a charger for charging the photosensitive member, a discharger in which the corona discharging system is used.

The charger of the corona discharging system includes a corona wire, formed by tungsten, stainless steel or the like, which is enclosed by a casing. The charger is arranged near the photosensitive member. When high voltage is applied to the corona wire, corona discharge occurs between the corona wire and the photosensitive member, the air around the corona wire is ionized, and ions are generated. The generated ions are moved to the surface of the photosensitive member to charge the surface of the photosensitive member.

It has been known that, in the charger of the corona discharging system, if dirt is adhered to the corona wire, the photosensitive member is not normally charged at the portion that contains the dirt, causing a charge failure at the photosensitive member. Such a charge failure results in significant deterioration in image quality because, for example, a solid black area may be formed on the printed image. It is thus necessary to sufficiently clean the corona wire in order to maintain good image quality.

For example, an image forming apparatus has been proposed, which includes a means for cleaning the corona wire in conjunction with opening and closing an access cover (see Japanese Patent Application Laid-Open No. 2006-251195). Another image forming apparatus has been proposed, which determines if there is dirt on a charger immediately after cleaning of the corona wire, and allows a printing operation to occur if it determines that there is no dirt (see Japanese Patent Application Laid-Open No. 2006-184826). By thus cleaning the corona wire on a regular basis and appropriately determining if there is dirt on the charger, the corona wire can be maintained in a clean condition, and it is possible to reduce the degradation of quality of the formed image.

The technique disclosed in Japanese Patent Application Laid-Open No. 2006-184826 has a configuration that detects charging current of the charger, determines if there is dirt on the charger based on the detected value of charging current, and provides a notification if there is dirt on the charger.

It is known, when the image forming apparatus forms an image on a paper, that two or more types of print speeds may be used for processing and that the print speed can be switched in accordance with, for example, the type of paper. Such an image forming apparatus requires a change in the standard used to determine the presence/absence of dirt on the charger, when the print speed is switched. This is because the rotation speed of the photosensitive member is also changed when the print speed is changed, and the voltage applied to the charger is further changed in order to obtain constant charging density.

The Japanese Patent Application Laid-Open No. 2006-184826, however, does not consider switching of the print speed. Therefore, in the image forming apparatus capable of processing with two or more types of print speeds, it is difficult to determine appropriately whether or not the corona wire needs to be cleaned depending on each print speed.

SUMMARY OF THE INVENTION

In view of the above problems, preferred embodiments of the present invention provide an image forming apparatus and an image forming method that can appropriately determine whether or not the charger needs to be cleaned depending on each print speed, even if the print speed is switched.

An image forming apparatus for performing an image forming process based on image data according to a preferred embodiment of the present invention in which a processing speed of the image forming process is changeable includes a corona discharger including a discharge member; a power supply arranged to apply a voltage to the discharge member; a detection unit arranged to detect a voltage applied by the power supply; and a determination unit arranged to determine a necessity to clean the discharge member based on whether or not a detection result obtained by the detection unit is equal to or more than a predetermined threshold in accordance with the processing speed.

An image forming apparatus for performing an image forming process based on image data according to another preferred embodiment of the present invention in which a processing speed of the image forming process is changeable includes a corona discharger including a discharge member; a power supply arranged to apply a voltage to the discharge member; a storage unit arranged to store thresholds corresponding to the each processing speed; a detection unit arranged to detect a voltage applied by the power supply; and a determination unit arranged to determine a necessity to clean the discharge member based on whether or not a detection result obtained by the detection unit is equal to or more than one of the thresholds corresponding to the processing speed.

According to various preferred embodiments of the present invention, the image forming apparatus is configured to be able to change the image forming speed, while the determination unit determines the necessity to clean the discharge member based on whether or not the voltage applied to the discharge member of the corona discharger is equal to or more than the predetermined threshold in accordance with the processing speed. Therefore, it is possible to determine appropriately whether or not the discharge member needs to be cleaned even when the processing speed is changed.

An image forming apparatus according to a preferred embodiment of the present invention includes a cleaning member arranged to clean a surface of the discharge member.

An image forming apparatus according to a preferred embodiment of the present invention includes a discharge member that is a corona wire.

According to a preferred embodiment of the present invention, an image forming apparatus includes a cleaning member arranged to clean a surface of the discharge member when it is determined that the discharge member needs to be cleaned. Thus, the discharge member can be maintained in a clean condition.

An image forming apparatus according to a preferred embodiment of the present invention includes an image bearing body, wherein the corona discharger is a charger arranged to charge a surface of the image bearing body.

According to a preferred embodiment of the present invention, an image forming apparatus appropriately determines the necessity to clean the discharge member of the corona discharger that charges the surface of the image bearing body, and prevents a charge failure of the image bearing body. Thus, the image forming apparatus allows the quality of the printed image to be well maintained.

An image forming apparatus according to a preferred embodiment of the present invention includes a notification unit arranged to provide a notification that the discharge member needs to be cleaned based on a determination made by the determination unit.

The notification unit preferably includes a liquid crystal display.

According to a preferred embodiment of the present invention, when it is determined that the discharge member needs to be cleaned, the image forming apparatus notifies the user by, for example, showing a message on the liquid crystal display.

An image forming apparatus according to a preferred embodiment of the present invention includes a print counter arranged to count a number of printed pages; and a control unit programmed and arranged to forcibly terminate the image forming process when a value indicated by the print counter reaches a predetermined value.

According to a preferred embodiment of the present invention, when it is determined that the discharge member needs to be cleaned, the number of printed pages is counted by the print counter, and the image forming process is forcibly terminated after printing is performed on a predetermined number of pages, to prohibit printing thereafter. The image forming is prohibited when the discharge member is dirty, and thus, it is possible to avoid deterioration in the image quality.

An image forming method according to yet another preferred embodiment of the present invention includes the steps of specifying an image forming speed; setting a threshold corresponding to the image forming speed; executing the image forming; detecting a voltage applied to a discharge member of a discharger; comparing the detected voltage with the set threshold; and determining a necessity to clean the discharge member based on a comparison result.

According to a preferred embodiment of the present invention, the image forming apparatus is configured to be able to change the image forming speed, and determines the necessity to clean the discharge member based on whether or not the voltage applied to the discharge member of the corona discharger is equal to or more than the threshold set in accordance with the processing speed. Therefore, it is possible to determine appropriately whether or not the discharge member needs to be cleaned even when the processing speed is changed.

The image forming method according to a preferred embodiment of the present invention includes a step of notifying that the discharge member needs to be cleaned if a necessity of cleaning is determined.

According to a preferred embodiment of the present invention, in the image forming apparatus and the image forming method, since the necessity to clean the discharge member is determined based on the predetermined threshold in accordance with the image forming speed, the determination of the necessity to clean the discharge member can appropriately be made even if the processing with any speed. The image forming apparatus can correctly notify that the discharge member needs to be cleaned based on the appropriate determination result. Thus, the user, field engineer or the like can clean the discharge member to maintain it in a clean condition.

According to a preferred embodiment of the present invention, the surface of the discharge member can be cleaned as appropriate using the cleaning member provided in the image forming apparatus, allowing the discharge member to be maintained in a clean condition. Furthermore, according to a preferred embodiment of the present invention, the image forming apparatus uses such a corona discharger maintained in a clean condition to charge the surface of the image bearing body, thus preventing the image bearing body from causing a charge failure and allowing the quality of the printed image to be well maintained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

The following will describe in detail an image forming apparatus according to preferred embodiments of the present invention with reference to the drawings. In the description below, the image forming apparatus according to preferred embodiments of the present invention will be explained as, for example, including a scanner function to read an image of an original document and a print function to form an image on a paper such as a copy paper or an OHP (Over Head Projector) sheet, for example, based on image data. The image forming apparatus according to preferred embodiments of the present invention may also include, in addition to the functions described above, a communicating function to transmit/receive data to/from an external device through a network, a facsimile function to transmit or receive data to/from an external facsimile device through a modem, and the like.

Figure 1:
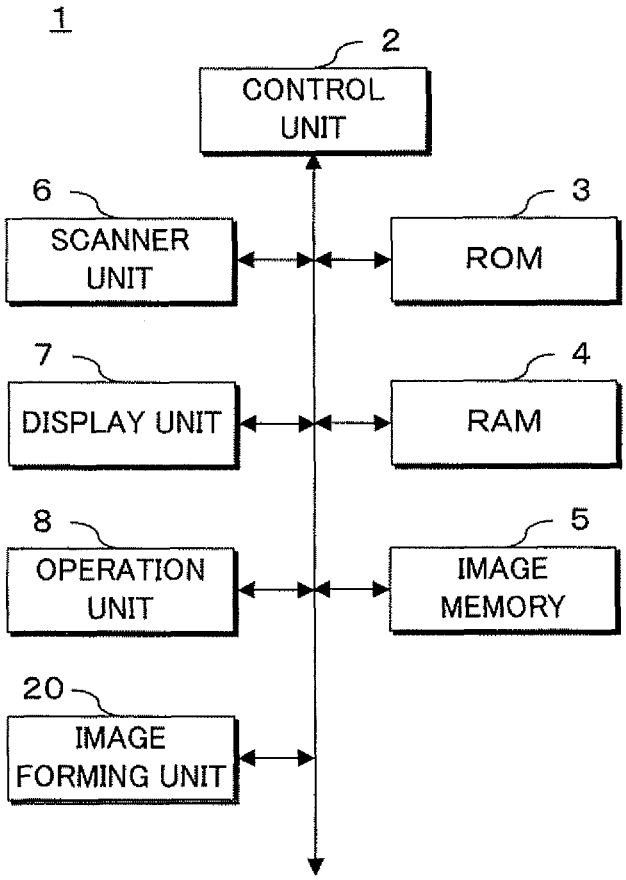
FIG. 1 is a block diagram illustrating the internal configuration of an image forming apparatus according to a preferred embodiment of the present invention.

FIG. 1 is a block diagram illustrating the internal configuration of the image forming apparatus according to a preferred embodiment of the present invention. The image forming apparatus 1 according to the present preferred embodiment of the present invention preferably includes a control unit 2, a ROM (Read Only Memory) 3, a RAM (Random Access Memory) 4, an image memory 5, a scanner unit 6, a display unit 7, an operation unit 8, an image forming unit 20 and the like. The hardware units described above are preferably interconnected with one another via a bus or other suitable connection, for example.

Specifically, the control unit 2 is a CPU (Central Processing Unit), a MPU (Micro Processing Unit) or the like. The control unit 2 controls each of the hardware units as described above that are connected thereto, while appropriately executing a control program stored in the ROM 3. The ROM 3 stores therein various control programs in advance, which are required for the image forming apparatus 1 to operate as the image forming apparatus according to a preferred embodiment of the present invention. The RAM 4 is a volatile memory such as a SRAM (Static RAM), a DRAM (Dynamic RAM) or the like, which temporarily stores data generated when the control unit 2 executes the control program. As the control unit 2 reads out the control programs stored in ROM 3 into the RAM 4 to sequentially execute the programs, the image forming apparatus 1 operates as the image forming apparatus according to a preferred embodiment of the present invention.

The ROM 3 of the present preferred embodiment stores in advance thresholds of voltage for each print speed at which the image forming apparatus 1 can execute the processing, as information that is used to determine whether or not a corona wire 221 in a charger 22 (see FIG. 2) needs to be cleaned. If the monitoring voltage corresponding to the current value of charged bias applied to the charger 22 reaches the threshold voltage or higher, it is determined that the corona wire 221 is dirty and thus needs to be cleaned. If, on the other hand, the monitoring voltage corresponding to the current value of the charged bias is less than the threshold voltage, it is determined that the corona wire 221 is not dirty and thus does not need to be cleaned.

In the charger 22 of the corona discharging system, when high voltage is applied to the corona wire 221, the corona wire 221 operates as a strong dust-collecting electrode, and spattered tonner, paper dust, air dust and the like will be adhered to the surface thereof. If dirt is adhered to the corona wire 221, the value of discharge resistance of the charger 22 is raised. Thus, an even higher voltage needs to be applied to the corona wire 221 in order to sufficiently charge a photosensitive drum 21 (see FIG. 2) by constant current control. In the constant current control, when the applied voltage reaches the upper limit of the high voltage power-supply, the current value is lowered to raise the monitoring voltage. When the monitoring voltage reaches a predetermined threshold voltage or more, the control unit 2 determines that an abnormality in charging occurs at the photosensitive drum 21, i.e., that dirt is adhered to the corona wire 221.

As the print speed is increased, the rotational speed of photosensitive drum 21 is controlled to be higher. It is necessary to supply a larger amount of electric current to the corona wire 221 in order to obtain a constant charge density. Thus, ROM 3 stores a lower threshold voltage as the print speed becomes faster. For example, when the charged bias is a value between about 5 KV and about 7 KV, the threshold voltage of about 1.13V is stored in ROM 3 for a faster print speed, whereas the threshold voltage of about 2.35V is stored in ROM 3 for a slower print speed.

Since the image forming apparatus 1 can perform the image forming process at two types of print speeds, two types of threshold voltages are stored in ROM 3. The image forming apparatus 1 may, however, be able to perform the image forming process at three or more types of print speeds, for example, in which case three or more types of threshold voltages are stored in ROM 3. The threshold voltage, corresponding to a value preset for each print speed, may be stored in a rewritable memory to be updated by the user or field engineer.

The scanner unit 6 corresponds to a reading unit including a light source directing light to read an original document, a CCD (Charge-Coupled Device) line image sensor and the like. The scanner unit 6 scans and reads an image by moving the light source in a direction (sub scanning direction) perpendicular to the long direction (main scanning direction) of the CCD line image sensor. The scanner unit 6 converts the light reflected from the document into an analog electric signal by the CCD line image sensor and obtains the converted signal as an image signal. Moreover, the scanner unit 6 includes an A/D (analog/digital) converter, which performs A/D conversion to the obtained analog image signal to convert it into the digital image signal (image data), and outputs the obtained image data to the image memory 5.

The scanner unit 6 may be a scanner using CIS (Contact Image Sensor). Moreover, the scanner unit 6 may correspond to FBS (Flat Bed Scanner) which reads a document placed on a predetermined document glass in a stationary state. Furthermore, the scanner unit 6 may be configured to sequentially read each of the separated papers of a document conveyed by ADF (Automatic Document Feeder) page by page from the stacked papers of document placed on a predetermined document glass.

The image memory 5 is a volatile memory such as a DRAM (Dynamic Random Access Memory). The image memory 5 temporarily stores, page by page, the image data obtained by the scanner unit 6 reading the document. The image data stored in the image memory 5 is read out in accordance with the instructions of control unit 2 and is output to the image forming unit 20. When the image forming apparatus 1 is configured to receive image data from an external device, the image memory 5 also stores the image data received from the external device.

The display unit 7 may be, for example, a LCD (Liquid Crystal Display), which displays an operating condition of the image forming apparatus 1, information to be given to the user, information input through the operation unit 8 and the like. The operation unit 8 is provided with various types of buttons for the user to operate the image forming apparatus 1. When the user operates any one of the buttons, the operation unit 8 transmits a control signal in accordance with the operated button to the control unit 2. The control unit 2 executes the process corresponding to the control signal obtained from the operation unit 8. A portion or an entirety of the display unit 7 and operation unit 8 may be configured with a touch screen.

The image forming unit 20 preferably is a printer device of the electrophotographic system. The image forming unit 20 selects a recording sheet or an OHP sheet of an optimal size from recording sheets or OHP sheets of different sizes such as A3SEF (short edge feed), B4SEF, A4SEF, B5LEF (long edge feed), A5LEF and the like, and records (prints) the image based on the image data output from the image memory 5 as a hard copy. Accordingly, the image forming unit 20 forms an image based on the image data obtained by the scanner unit 6 reading an original document. The image forming unit 20 of the present preferred embodiment can form an image at two types of print speeds, and forms an image at the print speed in accordance with the instructions from the control unit 2. Furthermore, the image forming unit 20 may be configured so as to be able to form an image at three or more types of print speeds.

The image forming apparatus 1 configured as described above operates as a copying machine which forms an image on a paper by the image forming unit 20 based on the image data read from the original document by the scanner unit 6. Moreover, if the image forming apparatus 1 can transmit or receive data to/from an external device, it operates as a network scanner which transmits the image data obtained by the scanner unit 6 to an external device. Furthermore, the image forming apparatus 1 operates as a network printer which forms an image on a paper by the image forming unit 20 based on the image data received from the external device.

In addition, if the image forming apparatus 1 can transmit or receive data to/from an external facsimile device, it operates as a facsimile transmitter which transmits the image data obtained by the scanner unit 6 to the external facsimile device. Furthermore, the image forming apparatus 1 operates as a facsimile receiver which forms an image on a paper by the image forming unit 20 based on the data received from an external facsimile device.

The image forming apparatus 1 of the present preferred embodiment may include, in addition to the configuration described above, a CODEC (coder and decoder) to encode the image data obtained by the scanner unit 6 reading an original document, a CODEC to decode the encoded image data and the like. Moreover, the image forming apparatus 1 of the present preferred embodiment may also include an image memory to store the encoded data.

Figure 2:
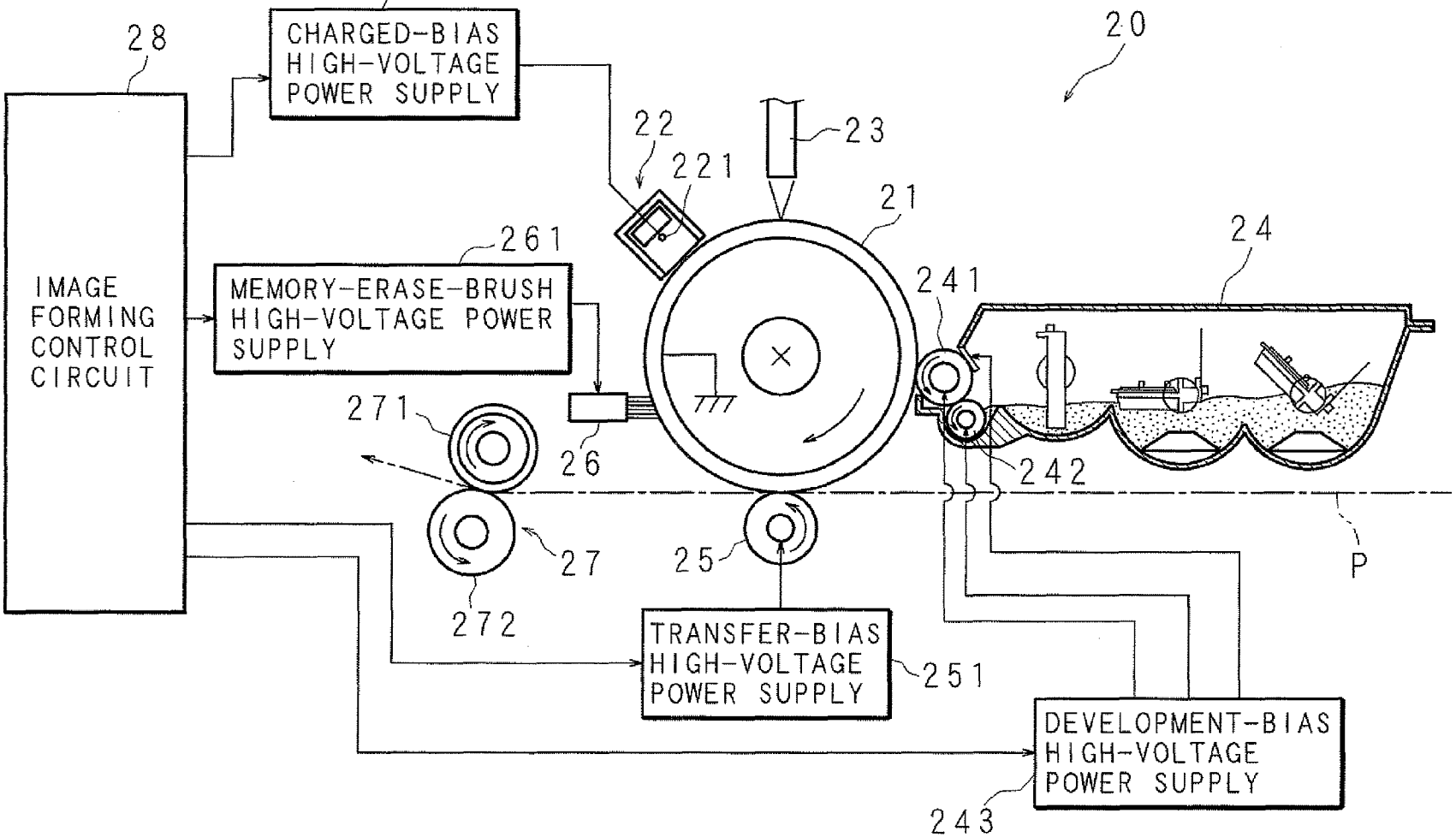
FIG. 2 is a schematic view illustrating the configuration of an image forming unit.

The configuration of the image forming unit 20 will now be described in detail. FIG. 2 is a schematic view illustrating the configuration of the image forming unit 20. The image forming unit 20 includes the photosensitive drum 21 as an image bearing body. Around the photosensitive drum 21, a charger 22, an exposing unit 23, a developing unit 24, a transfer roller 25, a memory erase brush 26 and the like are arranged in a clockwise direction.

In the photosensitive drum 21, a photosensitive layer is located on the outer circumference of an aluminum drum, for example, which rotates in the clockwise direction at predetermined speed in accordance with the power of motor (not shown). Though the image forming apparatus 1 includes the photosensitive drum 21 as the image bearing body, a photosensitive member formed in the shape of a belt can be used, for example, in place of the drum-shaped photosensitive member.

The charger 22 uniformly charges the surface of the photosensitive drum 21 at a predetermined potential. The charger 22 charges the surface of the photosensitive drum 21 with a negative polarity. The charger 22 shown in FIG. 2 is a corona charger (corona discharger) using the corona wire (discharge member) 221 configured with tungsten, stainless steel or the like. The corona wire 221 is connected to a charged-bias high-voltage power supply 222. When the corona wire 221 is applied with the charged bias by the charged-bias high-voltage power supply 222, corona discharge is generated between the corona wire 221 and the photosensitive drum 21. As a result, the air around the corona wire 221 is ionized to generate ions. The generated ions are directed to the surface of photosensitive drum 21, to charge the surface of the photosensitive drum 21.

The exposing unit 23 corresponds to a LSU (Laser Scanning Unit) provided with a laser directing unit directing laser light, a LED print head in which LEDs (Light Emitting Diodes) are arranged in array, or the like. The exposing unit 23 emits light based on the image data obtained from the image memory 5, and directs the light to the surface of photosensitive drum 21 charged by the charger 22 to remove the negative charge on the photosensitive drum 21. Accordingly, an electrostatic latent image corresponding to the image data is formed on the surface of photosensitive drum 21.

The developing unit 24 houses toner (developer) and includes a development roller 241 and a supply roller 242 to supply the toner to the surface of the photosensitive drum 21. The development roller 241 and supply roller 242 are driven by a motor (not shown) to rotate in a counter-clockwise direction at predetermined speed. The development roller 241 and supply roller 242 are connected to a high-voltage power supply for development bias (hereinafter also referred to as development-bias high-voltage power supply) 243. When the development roller 241 and supply roller 242 are applied with a development bias by the development-bias high-voltage power supply 243, the toner housed in the developing unit 24 is charged to have a positive polarity, while the charged toner is supplied to the latent image formed on the surface of the photosensitive drum 21.

The toner charged to have the positive polarity is attached to a portion of the surface of photosensitive drum 21 from which the positive charge is removed by the laser light. The developing unit 24 forms a toner image (image by toner) in which the latent image on the photosensitive drum 21 is visualized.

The transfer roller 25 is driven by a motor (not shown) to rotate in the counter-clockwise direction at a predetermined speed, and presses a paper conveyed along a conveyor path P to the photosensitive drum 21. Moreover, the transfer roller 25 is connected to a high voltage power supply for transfer bias (hereinafter also referred to as transfer-bias high-voltage power supply) 251. When the transfer roller 25 is applied with a transfer bias by the transfer-bias high-voltage power supply 251, a high voltage of polarity (negative polarity here) opposite to the charging polarity (positive polarity here) of the toner is applied to the paper conveyed along the conveyor path P. The transfer roller 25 presses the paper charged to the negative polarity onto the surface of photosensitive drum 21 to transfer the toner image formed on the photosensitive drum 21 to the paper. For transferring the toner image on the photosensitive drum 21 to a sheet of paper, a roller transfer method, a corona transfer method, a brush transfer method, a belt transfer method or other suitable method may preferably be used, for example.

In the conveyor path P, a fuser 27 arranged to fuse a toner image transferred on the paper by the transfer roller 25 is provided at the downstream of transfer roller 25. The fuser 27 includes a heat roller 271 in which a heater is embedded and a press roller 272 which is in press contact with the heat roller 271. The heat roller 271 is driven by a motor (not shown) to rotate in the clockwise direction at a predetermined speed. The press roller 272 is driven by a motor (not shown) to rotate in the counter-clockwise direction at the predetermined speed.

The paper on which the toner image is transferred by the transfer roller 25 is conveyed toward the fuser 27 along the conveyor path P. The fuser 27 places the conveyed paper between the heat roller 271 and press roller 272, the heat roller 271 maintained at a predetermined fusing temperature by the heater, and causes the heat roller 271 and press roller 272 rotate. The fuser 27 thermally fuses the toner image onto the paper by the heat and pressure from the rollers 271 and 272. The paper on which the toner image is fused is conveyed by a conveyor roller (not shown) and is discharged to a paper discharge tray.

The memory erase brush 26 is connected to a high voltage power supply for memory erase brush (hereinafter also referred to as memory-erase-brush high-voltage power supply) 261, and removes an electronic charge remaining on the surface of photosensitive drum 21 when a voltage is applied by the memory-erase-brush high-voltage power supply 261.

The image forming unit 20 of the present preferred embodiment may also include, in addition to the configuration shown in FIG. 2, a cleaner arranged to remove paper dust attached to the surface of photosensitive drum 21 after the toner image formed on the surface of photosensitive drum 21 is transferred onto the paper. The cleaner may be, for example, an electrostatic brush cleaner or a blade charged to have the positive polarity in order to more efficiently collect paper dust attached to the surface of photosensitive drum 21.

Moreover, the image forming unit 20 may also include a separator arranged to separate a paper, on which a toner image is transferred, from the photosensitive drum 21 in order to convey the paper to the fuser 27. The separator separates the paper from the photosensitive drum 21 by, for example, applying high voltage of positive polarity to the paper charged with negative polarity by the transfer roller 25. The separator may use various types of chargers or, alternatively, may use an electrode of a potential of FG (frame ground).

The image forming unit 20 includes an image forming control circuit 28 to control each unit described above in accordance with instructions from control unit 2. The image forming control circuit 28 controls the operation of the charged-bias high-voltage power supply 222, the development-bias high-voltage power supply 243, the transfer-bias high-voltage power supply 251, the memory-erase-brush high-voltage power supply 261 and the like. In addition, the image forming control circuit 28 controls the operation of the motor to rotate the photosensitive drum 21, development roller 241, supply roller 242, transfer roller 25, heat roller 271, press roller 272 and a conveyor roller (not shown).

Moreover, the image forming control circuit 28 of the present preferred embodiment monitors the current, which is supplied to the corona wire 221 by the charged-bias high-voltage power supply 222, in the form of monitoring voltage. The image forming control circuit 28 determines, based on the monitoring voltage, whether or not the corona wire 221 needs to be cleaned. More specifically, the image forming control circuit 28 obtains a monitoring voltage at a predetermined timing when the image forming unit 20 forms an image in accordance with the instructions from the control unit 2. The image forming control circuit 28 monitors a charged current (monitoring voltage) at a timing corresponding to, for example, the time when the photosensitive drum 21 is rotated in order to remove the electrical charge on the photosensitive drum 21 with the memory erase brush 26 after the printing process. Furthermore, the image forming control circuit 28 may also monitor the charged current while the photosensitive drum 21 is rotated in order to charge the photosensitive drum. 21 by the charger 22 before the printing process.

The image forming control circuit 28 compares the obtained monitoring voltage with the threshold voltage set by the control unit 2, to determine that the corona wire 221 needs to be cleaned if the monitoring voltage is equal to or more than the threshold voltage. If, on the other hand, the monitoring voltage is less than the threshold voltage, the image forming control circuit 28 determines that the corona wire 221 does not need to be cleaned.

When a printing process (image forming process) is executed by the image forming unit 20, the image forming apparatus 1 changes the print speed of the image forming unit 20 depending on the type of papers, i.e., a plain paper, a heavy paper, an envelope, a postcard or the like, for example. The control unit 2 selects a threshold voltage among the threshold voltages stored in ROM 3 in accordance with the print speed for the printing process executed or to be executed by the image forming unit 20. The control unit 2 sets the selected threshold voltage to the image forming control circuit 28 of the image forming unit 20.

If the image forming control circuit 28 determines that the corona wire 221 needs to be cleaned, the circuit 28 notifies the control unit 2 of this fact. The control unit 2 then causes the display unit 7 to show a message such as "please clean the charger," for example, to notify the user that the corona wire 221 needs to be cleaned. The image forming apparatus 1 may also be provided with an alarm lamp or an alarm buzzer. If the image forming control circuit 28 detects that the corona wire 221 needs to be cleaned, the control unit 2 may turn on or repeatedly turn on and off the alarm lamp, or turn on the sound of the alarm buzzer. Such a configuration can notify, visually or aurally, the user that the corona wire 221 needs to be cleaned.

Moreover, if it is determined that the corona wire 221 needs to be cleaned, the control unit 2 prohibits a further printing process after a predetermined number of pages has been printed since the determination. More specifically, a print counter is provided at the control unit 2. If it is determined that the corona wire 221 needs to be cleaned, the control unit 2 increments, after the determination, the value of the print counter every time the printing process for one page is completed. When the count value of the print counter reaches a predetermined number, the control unit 2 causes the display unit 7 to show a message such as, for example, "immediately clean the charger," and prohibits the printing process from being performed thereafter.

Since the printing in the state that dirt is attached to the corona wire 221 is prohibited, the image forming apparatus 1 can prevent deterioration in the image quality due to a charge failure of the photosensitive drum 21. It is preferable to determine the threshold voltage that is used to determine the necessity to clean the corona wire 221 on an experimental basis, such that an optimal value in line with the actual condition can be obtained. By thus determining the threshold voltage, reliability can be improved for determination of the necessity to clean the corona wire 221.

Figure 3:
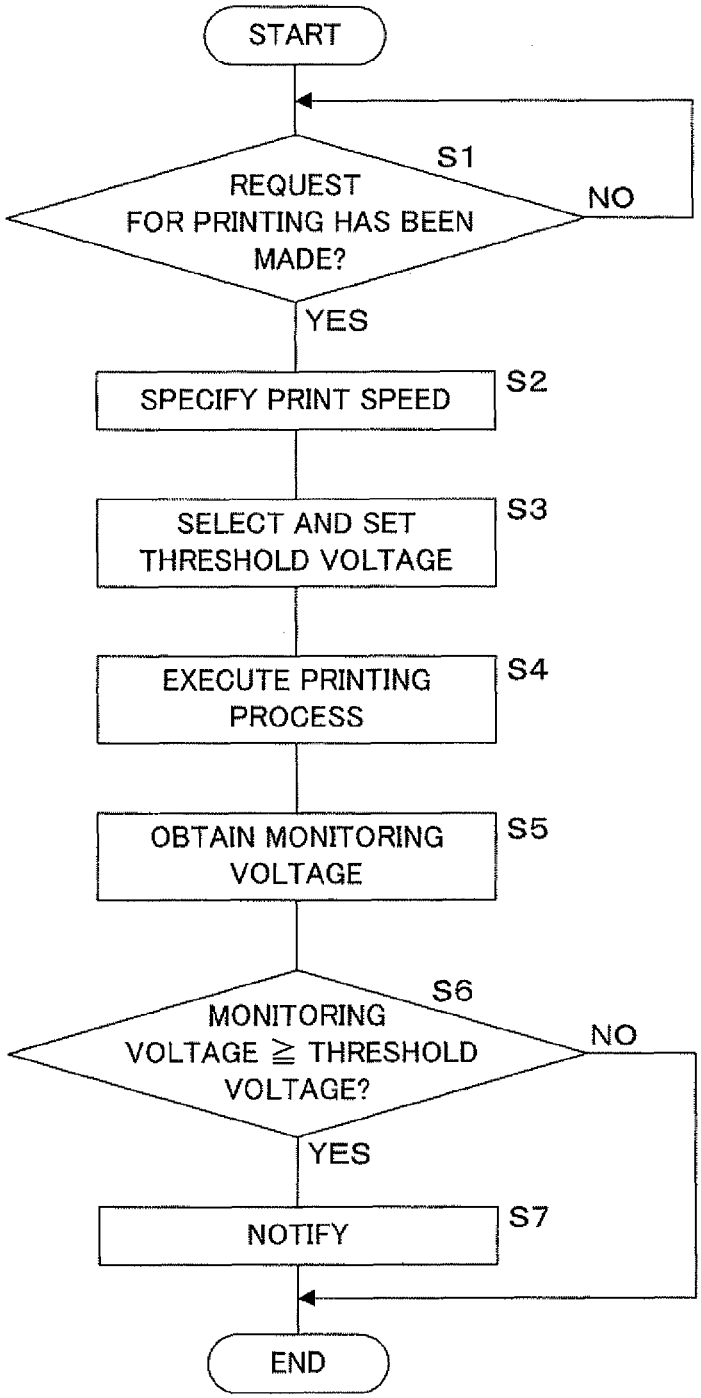
FIG. 3 is a flowchart illustrating a printing process performed by the image forming apparatus.

The processing performed by the control unit 2 during the printing process in the image forming apparatus 1 with a configuration described above will now be described below with reference to a flowchart. FIG. 3 is a flowchart illustrating a printing process performed by the image forming apparatus 1. The control unit 2 executes the printing process in accordance with the control program stored in ROM 3.

The control unit 2 determines whether or not a request for printing has been made based on, for example, whether or not a button for indicating the start of copying is operated (S1). If no request for printing has been made (S1: NO), the control unit 2 waits while performing other processing. If a request for printing has been made (S1: YES), the control unit 2 specifies a print speed used during the printing process depending on the type of a paper or the type of a process (priority on speed, quality or the like) selected through the operation unit 8 (S2).

For example, the control unit 2 selects the printing process with high print speed when a plain paper is selected, while it selects the printing process with low print speed when a paper thicker than the plain paper, such as a heavy paper, an envelope or a postcard is selected. Furthermore, the control unit 2 selects the printing process with high print speed when the processing with "priority on speed" is selected, while it selects the printing process with low print speed when the processing with "priority on image quality" is selected.

The control unit 2 selects a threshold voltage corresponding to the specified print speed from the threshold voltages stored in ROM 3. The control unit 2 sets the selected threshold voltage to the image forming unit 20 (S3). The control unit 2 executes the printing process at the print speed specified in step S2 (S4). The image forming control circuit 28 of the image forming unit 20 obtains the monitoring voltage for the charged-bias high-voltage power supply 222 as a detection signal (S5). The timing for obtaining the monitoring voltage may correspond to any of the timings at a preceding rotation process which rotates the photosensitive drum 21 before the image forming unit 20 performs image forming, a succeeding rotation process which rotates the photosensitive drum 21 after the image forming unit 20 performs image forming, or an image forming process performed by the image forming unit 20.

The image forming control circuit 28 determines whether or not the obtained monitoring voltage is equal to or more than the threshold voltage set at step S3 (S6). If the image forming control circuit 28 determines that the monitoring voltage is less than the threshold voltage (S6: NO), the control unit 2 terminates the processing without any action. If the image forming control circuit 28 determines that the monitoring voltage is equal to or more than the threshold voltage (S6: YES), the control unit 2 notifies that the corona wire 221 needs to be cleaned (S7). For example, the control unit 2 causes the display unit 7 to show such a message as "please clean the charger" and terminates the processing.

Figure 4:
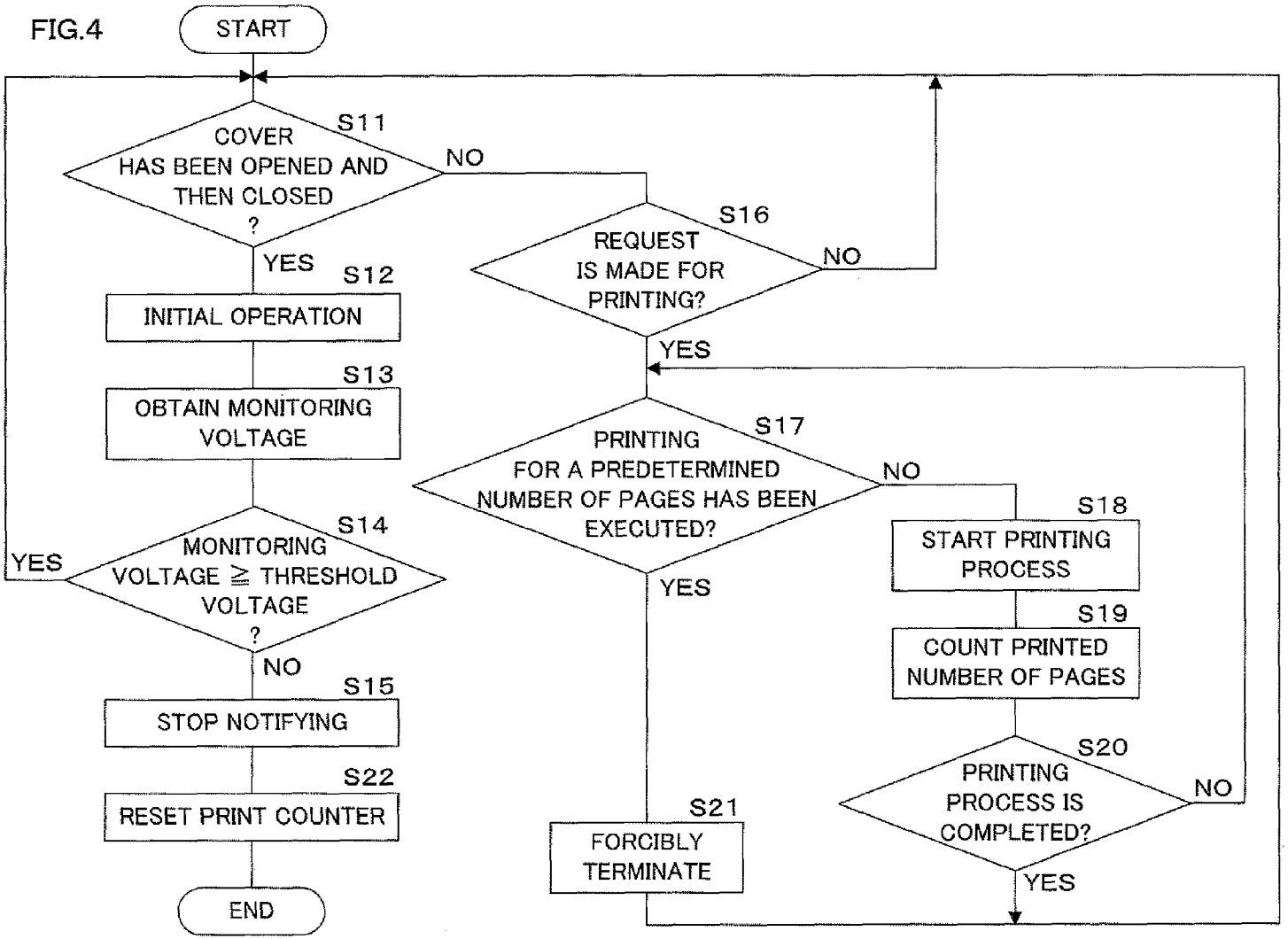
FIG. 4 is a flowchart illustrating a notification terminating process performed by the image forming apparatus.

A description will now be provided of the process performed by the image forming apparatus 1, which determines that the corona wire 221 needs to be cleaned and notified the user thereof, when the notification to the user is terminated. FIG. 4 is a flowchart illustrating a notification terminating process performed by the image forming apparatus 1. In accordance with the control program stored in ROM 3, the control unit 2 executes the processing as described below.

The image forming apparatus 1 is provided with a cover sensor (not shown) arranged to detect opening/closing of a cover opened when the corona wire 221 of charger 22 is cleaned. The control unit 2 determines, based on the detection signal from the cover sensor, whether or not the cover has been opened and then closed (S11). Since the user who cleans the corona wire 221 has to open and close the cover of the image forming apparatus 1, the control unit 2 determines whether or not the corona wire 221 is cleaned when the cover is opened and closed. Moreover, since the user who cleans the corona wire 221 may turn off the power of the image forming apparatus 1, the control unit 2 may also determine whether or not the corona wire 221 is cleaned when the power is turned on. Here, the control unit 2 determines whether or not the power of the image forming apparatus 1 is turned on instead of whether or not the cover is opened and closed.

If it is determined that the cover is opened and closed (S11: YES), the control unit 2 causes each portion in the image forming unit 20 to perform an initial operation as preparation for the image forming process performed by the image forming unit 20 (S12). After the initial operation of the image forming unit 20, the image forming control circuit 28 of image forming unit 20 obtains the monitoring voltage for the charged-bias high-voltage power supply 222 as a detection signal (S13).

The image forming control circuit 28 determines whether or not the obtained monitoring voltage is equal to or more than the threshold voltage that has already been set at step S3 in FIG. 3 (S14). If the image forming control circuit 28 determines that the monitoring voltage is less than the threshold voltage (S14: NO), the control unit 2 stops notifying that the corona wire 221 needs to be cleaned (S15), resets the print counter (S22) and terminates the processing described above. Here, the control unit 2 continuously executes the process illustrated in FIG. 3. If the monitoring voltage becomes less than the predetermined threshold after the cover is opened and closed, the control unit 2 determines that the corona wire 221 is appropriately cleaned and stops notifying. The control unit 2 then resets the print counter and returns to the regular operation.

If, on the other hand, the image forming control circuit 28 determines that the monitoring voltage is equal to or more than the threshold voltage (S14: YES), the control unit 2 returns to the processing of step S11 while continuously notifying that the corona wire 221 needs to be cleaned. If the monitoring voltage is not less than the predetermined threshold even when the cover is opened and closed, the control unit 2 determines that the corona wire 221 has not been appropriately cleaned and continues notifying that the corona wire 221 needs to be cleaned.

If the control unit 2 determines that the cover has not been opened and closed (S11: NO), the control unit 2 determines whether or not a request is made for printing based on, for example, whether or not the button to indicate the start of copying is operated (S16). If the control unit 2 determines that the request for printing has not been made (S16: NO), the control unit 2 returns to the processing of step S11 and waits while performing other processing. If it is determined that the request for printing has been made (S16: YES), the control unit 2 determines whether or not printing for a predetermined number of pages has been executed based on the count value of the print counter (S17). If it is determined that the printing for the predetermined number of pages has not been executed (S17: NO), the control unit 2 starts the required printing process (S18). The control unit 2 increments the value of the print counter every time the printing process for one page is executed, and counts the printed number of pages (S19).

The control unit 2 determines whether or not the printing process started at step S18 is completed (S20). If it is determined that the printing process is not completed (S20: NO), the control unit 2 proceeds to step S17. The control unit 2 repeats the processing between S17 and S20 until the printing process started at step S18 is completed, or until printing is executed for a predetermined number of pages since the determination was made that the corona wire 221 needs to be cleaned. If it is determined that the printing process started at step S18 is completed (S20: YES), the control unit 2 returns to the processing of step S11 while continuously notifying that the corona wire 221 needs to be cleaned.

If it is determined that printing has been performed for the predetermined number of pages since the determination was made that the corona wire 221 needs to be cleaned (S17: YES), the control unit 2 forcibly terminates the running printing process (S21). The control unit 2 then returns to the processing of step S11 while continuously notifying that the corona wire 221 needs to be cleaned. When the printing process is forcibly terminated, the control unit 2 may cause the display unit 7 to show such a message as, for example, "printing is terminated because the charger is dirty" in addition to the message such as "immediately clean the charger." Accordingly, the image forming apparatus 1 can notify the user of the forcible termination during printing.

As described above, the image forming apparatus 1 can perform the printing process with two different types of print speeds. When the printing process is performed with a different print speed, the threshold voltage used to determine the necessity to clean the corona wire 221 is also changed. The image forming apparatus 1 can determine whether or not the corona wire 221 needs to be cleaned based on the threshold voltage according to the print speed for the printing process to be executed and on the monitoring voltage for the charged-bias high-voltage power supply 222. The image forming apparatus 1 can appropriately determine whether or not the corona wire 221 needs to be cleaned during the printing process executed at any print speed. Every time it is determined that the corona wire 221 needs to be cleaned, the user or field engineer cleans the corona wire 221 to maintain the image forming apparatus 1 to have a good image quality without a charge failure occurring on the photosensitive drum 21.

The image forming apparatus 1 includes, in addition to the configuration described above, a cleaning member that enables the user to easily clean the surface of the corona wire 221. For example, the image forming apparatus 1 is provided with a mechanism arranged to operate a predetermined lever to cause a foamed material that cleans the corona wire 221 (or to cause the corona wire 221 itself) slide on the surface of the corona wire 221 (or the foamed material). The user can easily clean the corona wire 221 by opening the cover of image forming apparatus 1 and operating the lever. According to such a configuration, the user can clean the corona wire 221 every time the image forming apparatus 1 notifies the user that the corona wire 221 needs to be cleaned, allowing the image quality to be maintained in a good condition. Alternatively, the user or field engineer may open the cover of the image forming apparatus 1 to take out the charger 22, and clean the corona wire 221 by, for example, rubbing it with foamed material.

In the present preferred embodiment, the charger 22 including the corona wire 221 as a discharge member was described by way of example. It is also possible to alternatively use a pin array charger arranged with its tip ends opposed to each other on the surface of the photosensitive drum 21.

The present preferred embodiment described, by way of example, a configuration to determine whether or not the corona wire 221 needs to be cleaned for the charger 22 charging the surface of photosensitive drum 21. In addition, in the case where, for example, a corona transfer method is used to transfer the toner image on the photosensitive drum 21 to a paper while a corona discharger is used as a transfer unit instead of the transfer roller 25, the processing described above can also be performed to determine whether or not the transfer unit needs to be cleaned. Since the necessity to clean the transfer unit can precisely be determined, the transfer unit can be cleaned at an appropriate timing. Accordingly, a paper to be charged by the transfer unit is prevented from causing a charge failure, and the toner image on the photosensitive drum 21 can appropriately be transferred to the paper.

Also in a configuration using a corona discharger at a separator arranged to separate a paper with a transferred toner image from the photosensitive drum 21, the processing as described above can be performed to determine whether or not the separator needs to be cleaned. Since the necessity to clean the separator can precisely be determined, the separator can be cleaned at an appropriate timing. Accordingly, a paper to be charged by the separator is prevented from causing a charge failure, and the paper can appropriately be separated from the photosensitive drum 21. This also applies to the configuration in which a corona discharger is used as a cleaner to collect and remove toner remaining on the surface of the photosensitive drum 21 after the toner image on the photosensitive drum 21 is transferred to the paper.

In the preferred embodiment described above, the photosensitive drum 21 is preferably charged to have a positive polarity by the charger 22 and toner is also preferably charged to have a positive polarity by the development roller 24 and supply roller 24, while the paper is preferably charged to have a negative polarity by the transfer roller 25. The image forming unit 20 may, however, be configured in that each of the above is charged to have a polarity opposite to the above-described polarity. More specifically, it is also possible that the photosensitive drum 21 is charged to have a negative polarity by the charger 22 and the toner is charged to have a negative polarity by the development roller 24 and supply roller 24, while the paper is charged to have a positive polarity by the transfer roller 25.

Though preferred embodiments of the present invention have been described above in detail, each of the configurations, operations and the like can appropriately be altered and are not limited to the preferred embodiments described above.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An image forming apparatus for performing an image forming process based on image data such that a processing speed of the image forming process is changeable, the image forming apparatus comprising:

a corona discharger including a discharge member;

a power supply that applies a voltage to the discharge member;

a detection unit that detects a voltage applied by the power supply; and a determination unit that determines a necessity to clean the discharge member based on whether or not a detection result obtained by the detection unit is equal to or more than a predetermined threshold in accordance with the processing speed.

2. The image forming apparatus according to claim 1, further comprising a cleaning member arranged to clean a surface of the discharge member.

3. The image forming apparatus according to claim 1, wherein the discharge member is a corona wire.

4. The image forming apparatus according to claim 1, further comprising an image bearing body, wherein the corona discharger is a charger arranged to charge a surface of the image bearing body.

5. The image forming apparatus according to claim 1, further comprising a notification unit that provides a notification, based on a determination made by the determination unit, that the discharge member needs to be cleaned.

6. The image forming apparatus according to claim 5, wherein the notification unit is a liquid crystal display.

7. The image forming apparatus according to claim 1, further comprising:

a print counter that counts a number of printed pages; and a control unit that forcibly terminates the image forming process when a value indicated by the print counter reaches a predetermined value.

8. An image forming apparatus for performing an image forming process based on image data such that a processing speed of the image forming process is changeable, the image forming apparatus comprising:

a corona discharger including a discharge member;

a power supply that applies a voltage to the discharge member;

a storage unit that stores thresholds corresponding to the each processing speeds;

a detection unit that detects a voltage applied by the power supply; and a determination unit that determines a necessity to clean the discharge member based on whether or not a detection result obtained by the detection unit is equal to or more than one of the thresholds corresponding to the processing speed.

9. The image forming apparatus according to claim 8, further comprising a cleaning member arranged to clean a surface of the discharge member.

10. The image forming apparatus according to claim 8, wherein the discharge member is a corona wire.

11. The image forming apparatus according to claim 8, further comprising an image bearing body, wherein the corona discharger is a charger arranged to charge a surface of the image bearing body.

12. The image forming apparatus according to claim 8, further comprising a notification unit that provides a notification, based on a determination made by the determination unit, that the discharge member needs to be cleaned.

13. The image forming apparatus according to claim 12, wherein the notification unit is a liquid crystal display.

14. The image forming apparatus according to claim 8, further comprising:

a print counter that counts a number of printed pages; and a control unit that forcibly terminates the image forming process when a value indicated by the print counter reaches a predetermined value.

15. An image forming method of performing an image forming process based on image data, the method comprising the steps of:

specifying an image forming speed;

setting a threshold corresponding to the image forming speed;

executing the image forming process;

detecting a voltage applied to a discharge member of a discharger;

comparing the detected voltage with the threshold set in the step of setting; and determining a necessity to clean the discharge member based on a result of the step of comparing.

16. The image forming method according to claim 15, further comprising the step of providing a notification that the discharge member needs to be cleaned if a necessity of cleaning is determined in the step of determining.

* * * * *